United States Patent [19]

Hill

[11] Patent Number: 4,573,754

[45] Date of Patent: Mar. 4, 1986

[54] LAMP ASSEMBLY

[75] Inventor: Clinton W. Hill, Romeo, Mich.

[73] Assignee: U.S. Plastics Corp., Mt. Clemens, Mich.

[21] Appl. No.: 589,365

[22] Filed: Mar. 14, 1984

[51] Int. Cl.[4] ..... H01R 11/00

[52] U.S. Cl. ..... 339/60 M; 339/119 L; 339/176 L; 339/206 L; 339/154 L

[58] Field of Search ..... 339/59 L, 60 R, 60 C, 339/60 M, 61 L, 91 L, 119 L, 125 L, 154 L, 176 L, 206 L, 210 T, 221 L, 278 L, 189 L

[56] References Cited

U.S. PATENT DOCUMENTS

| | | | |
|---|---|---|---|
| 3,263,204 | 7/1966 | FitzGerald | 339/154 L |
| 3,999,095 | 12/1976 | Pearce, Jr. et al. | 339/91 L |
| 4,082,398 | 4/1978 | Bourdon et al. | 339/59 M |
| 4,100,448 | 7/1978 | Chipner et al. | 339/125 L |

*Primary Examiner*—Gil Weidenfeld
*Assistant Examiner*—Paula A. Austin
*Attorney, Agent, or Firm*—Neal A. Waldrop; Jay C. Taylor

[57] ABSTRACT

A lamp assembly for automotive tail lamps or the like comprising a base member of a relatively soft elastomeric material, a connector of a relatively hard material adapted to be sealingly but releasably plugged into a cavity opening in one face of the base member, and a bulb socket of a relatively hard material adapted to be sealingly but releasably plugged into another cavity in the base opening in a face which is normal to the face in which the connector is received. A plurality of conductors extend in parallel fashion in the base member between the socket cavity and the connector cavity. The conductors make electrical connection at their one ends with contacts on the lower end of the socket and pass sealingly through a partition separating the two cavities where their other ends make electrical contact with terminals carried by the connector. The connector, base, and socket are effective to provide a moisture sealed lamp assembly with each assembly or reassembly.

23 Claims, 10 Drawing Figures

10g
12g
10
10k
12c
12
10b
10a
20
20b
36
22
22b
38
24b
24
10f
40
10L
12a
12d 18
18d
18e
18b 18f
18c
48c
18a
46c
44c 16a
16
42
16b
16c
18e
18d
18
18b
18f
18g
18c
14
14b
14g
14f
14c
14a
14d
10
10k
10a
2
10m
10g
20a
10c
10i
10L
12g
10b
22b
12c
12
12h
20b
36
10d
12e
24a
2
12c
22a
38
12f
12j
12d
40

30
28b
28
32
28a 28
32

28a
32
30

28a

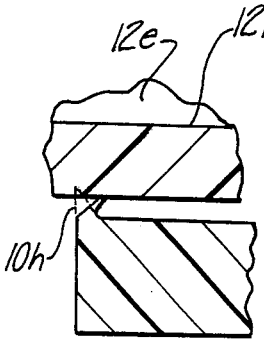
Fig-2B
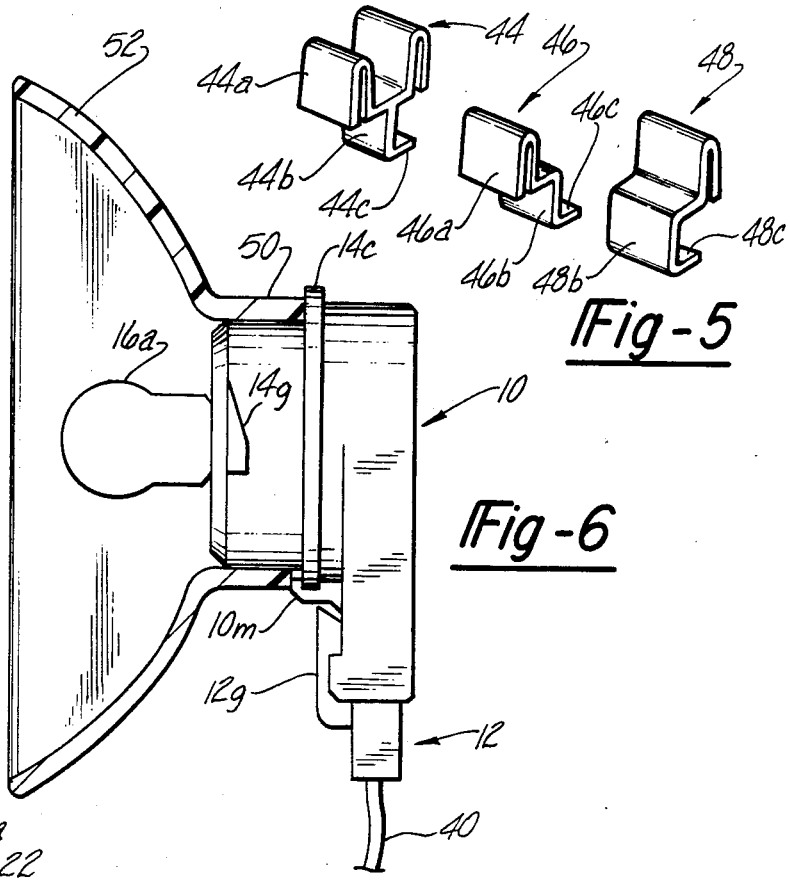
Fig-5
Fig-6
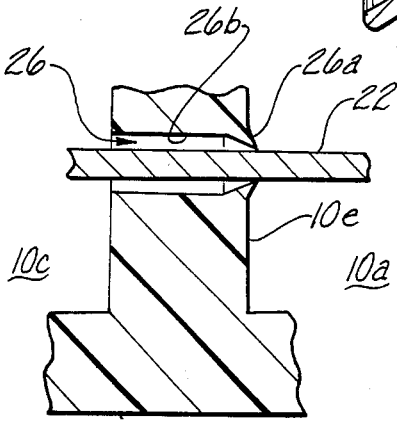
Fig-2A
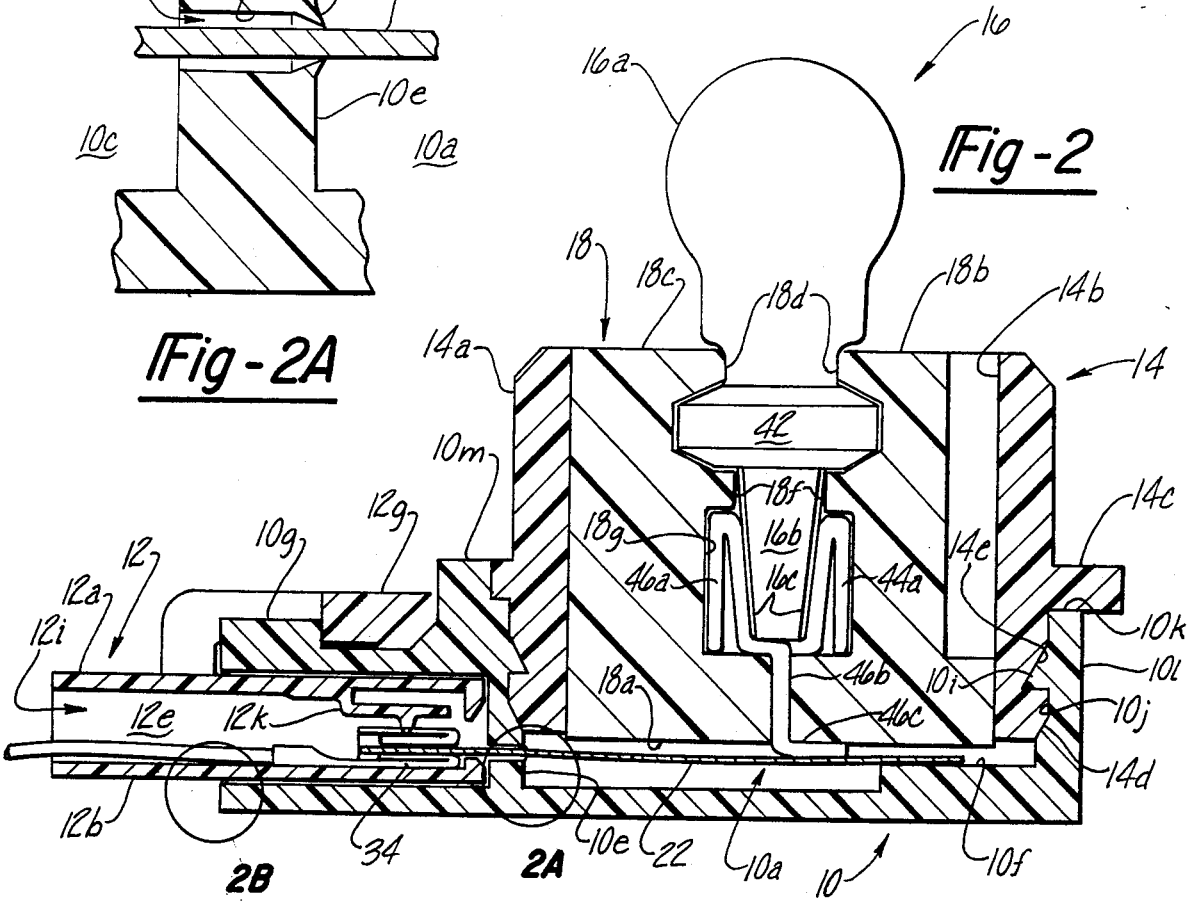
Fig-2

LAMP ASSEMBLY

BACKGROUND OF THE INVENTION

This invention relates to lamp assemblies and, more particularly, to lamp assemblies particularly suited for automotive applications.

A myriad of lamp assembly designs have been proposed and/or utilized for automotive lamp applications such, for example, as tail light assemblies. While these prior art devices have in general provided satisfactory and reliable lighting, they have also each embodied certain limitations. Specifically, automotive lamp applications dictate rather strong moisture sealing requirements. Moisture sealing in prior art designs have been accomplished either by encapsulating or "potting" the entire lamp assembly in a plastic substance, or by packing the various lamp cavities with a grease compound. Both prior art sealing concepts embody two basic shortcomings. Specifically, the sealed lamp is difficult to work with in the original automobile assembly process since, once assembled as a sealed unit, it must thereafter be handled as a single, non-divisible, sealed entity and special care must be taken to avoid derogation of the seal. Further, if the lamp is thereafter disassembled for any reason, the seal is destroyed and cannot be readily reestablished.

SUMMARY OF THE INVENTION

It is accordingly an object of the present invention to provide a lamp assembly for automotive applications or the like in which the lamp may be selectively assembled in the specific manner and sequence that is most compatible with the original automobile assembly process and which may thereafter be readily disassembled and/or reassembled without derogation of the seal.

This object is accomplished in accordance with the present invention by the provision of a lamp assembly in which moisture sealing is accomplished throughout the assembly by resealable mechanical means. The invention lamp assembly includes a socket assembly, a base, and a plurality of elongated conductors. One end of the socket assembly is sealingly but releasably mounted in one face of the base with contacts on the mounted socket assembly end positioned in a socket cavity in the base, and the elongated conductors pass sealingly through a wall of the base to position their inboard ends in the socket cavity in respective electrical connection with the contacts of the socket assembly.

According to a further feature of the invention, the lamp assembly further includes a connector having a plurality of terminals adapted to respectively electrically connect with the outboard ends of the conductors. In the disclosed preferred embodiment of the invention, the connector terminals are positioned in one end of the connector; that end of the connector is sized and configured to be inserted into a connector cavity defined in the base and separated from the socket cavity by the base wall through which the elongated conductors pass; and the outboard ends of the elongated conductors are positioned in the connector cavity for respective electrical connection to the connector terminals upon insertion of the connector into the connector cavity.

According to another feature of the invention, the socket assembly includes a hollow socket and a retainer element positioned within the socket and defining a rectangular cavity for receipt of a wedge base bulb. In the disclosed embodiment of the invention, the rectangular bulb cavity is defined by a pair of opposing walls and at least one of the walls is defined by a yieldable finger which wedges open upon insertion of the bulb to allow passage of the leading edge of a collar on the base of the bulb and thereafter snaps back to releasably grasp the bulb collar.

According to another feature of the invention, an electrical assembly is provided in which an elongated electrical conductor element extends through a passage in a partition of a housing assembly for electrical contact at its inboard end with an electrical terminal disposed within a sealed cavity defined by the housing assembly. The passage tapers inwardly at its inboard end to form inwardly extending lip means and the conductor element has a thickness slightly greater than the width of the passage at the lip means and slightly less than the width of the outboard end of the passage so that the conductor element, upon insertion through the passage into the cavity, coacts with the lip means to form a tight seal for the cavity at the partition and to resist withdrawal of the conductor element through the passage.

BRIEF DESCRIPTION OF THE DRAWINGS

FIG. 2 is an elevational view, in cross section, of the invention lamp assembly;

FIGS. 2A and 2B are enlarged views of selected portions of FIG. 2;

FIG. 5 is a perspective view of electrical contact elements employed in the invention lamp assembly;

FIG. 6 is a partially fragmentary view of the invention lamp assembly shown in association with a lamp housing and parabola.

DETAILED DESCRIPTION OF THE PREFERRED EMBODIMENT

Figure 3:
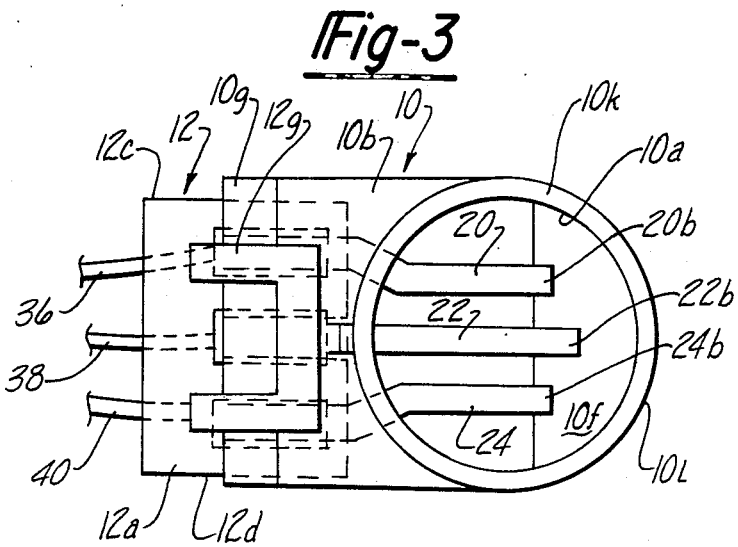
FIG. 3 is a top view of the invention lamp assembly with certain elements of the assembly omitted for clarity of illustration.
Figure 4:
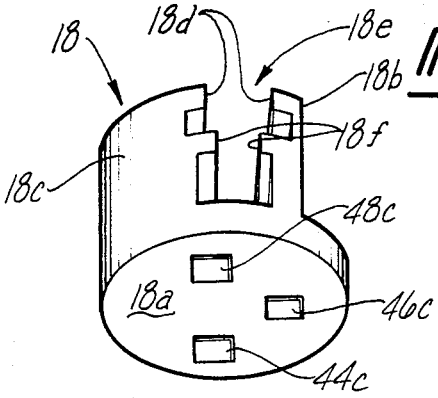
FIG. 4 is a bottom perspective view of a bulb retainer element employed in the invention lamp assembly.
Figure 1:
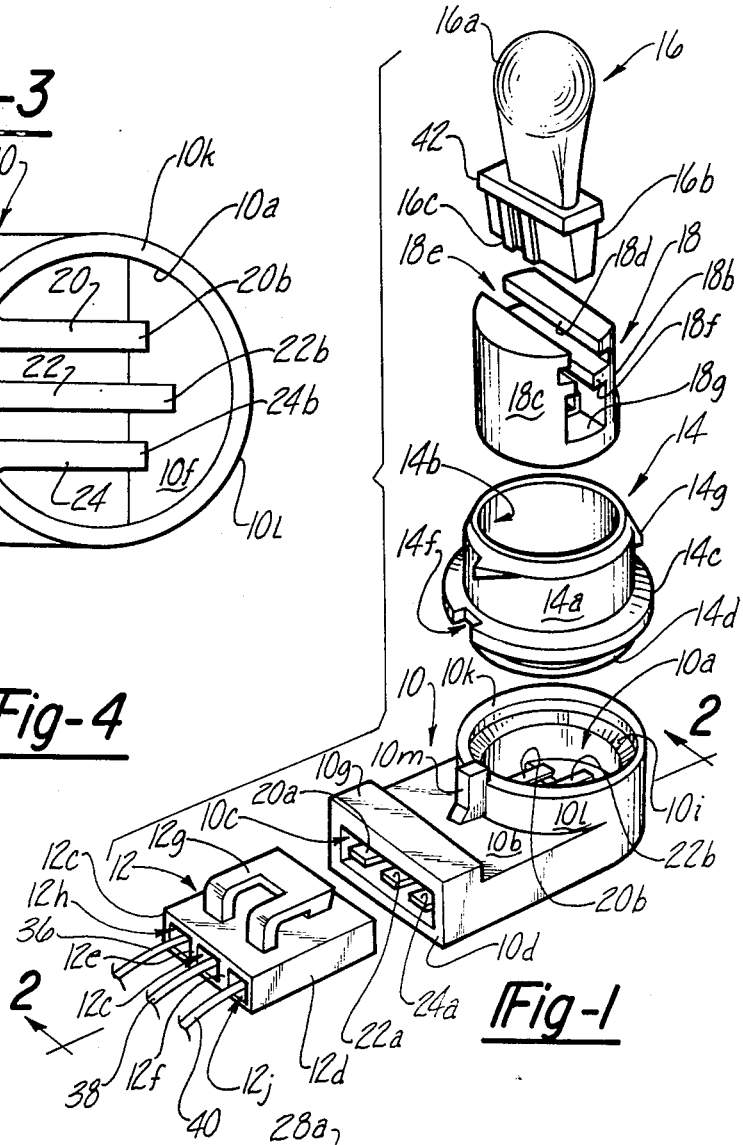
FIG. 1 is an exploded perspective view of the invention lamp assembly.

The invention lamp assembly, broadly considered, comprises a base 10, a connector 12, a socket 14, a bulb 16, and a bulb retainer 18.

Base 10 is formed of a resilient, plastic material such, for example, as a polyurethane or an acrylamide. Base 10 includes a socket cavity **10*a* opening at the upper face 10*b* of the base, and a connector cavity 10*c* opening in an end face 10*d* of the base. Connector cavity 10*c* is separated from socket cavity 10*a* by a wall or partition 10*e*. Three elongated conductor bars 20, 22, 24 of rectangular conductor bar stock, extend in parallel fashion within base 10. Bars 20, 22, 24 may, for example, be formed of beryllium copper material. One end 20*a*, 22*a*, 24*a* of each conductor bar is positioned in connector cavity 10*c* and the other end 20*b*, 22*b*, 24*b* of each conductor bar is supported on a platform surface 10*f* provided on the bottom of socket cavity 10*a*. Intermediate their ends, conductor bars 20, 22, 24 pass through passages 26 (FIG. 2A) extending longitudinally through partition 10*e*. Each passage 26 is rectangular in cross section and is necked down adjacent socket cavity 10*a* to form opposing lip portions 26*a* which taper outwardly in the direction of connector cavity 10***b* to blend with the main body portion 26*b* of the passage. Conductor bars 20, 22, 24 have a thickness that is slightly greater than the height of the opening defined between the relaxed lip portions 26*a* and slightly less than the height of passage portion 26*b* and a width that is slightly greater than the width of passage 26 so that, as the bars are selectively inserted through connector cavity 10*c* and through passages 26, lip portions 26*a* are splayed resiliently outwardly to pass the bars and allow the ends 20*b*, 22*b*, 24*b* to be seated on platform surface 10*f*. With the bars thus inserted in base 10, lip portions 26*a* coact with the respective upper and lower surfaces of the conductor bars and the side edges of the bars form an interference fit with the adjacent material of the base. Bars 20, 22, 24 thus form a moisture seal for socket cavity 10*a* at partition 10*e*. Lip portions 26*a* also coact with the engaged bar surfaces to resist withdrawal of the bars since any attempted withdrawal of a bar will tend to pivot lip portions 26*a* toward a more tightly closed clamping configuration. This arrangement prevents inadvertent withdrawal or displacement of the conductor bars while yet permitting withdrawal upon the application of a delibrate withdrawl force and, if desired, subsequent reinsertion for reassembly purposes.

Figure 7:
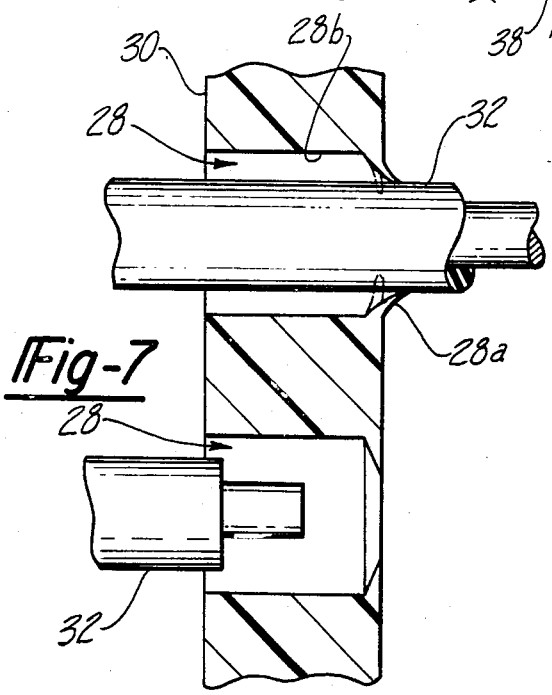
FIGS. 7 and 8 are views of a modified moisture sealing construction.
Figure 8:
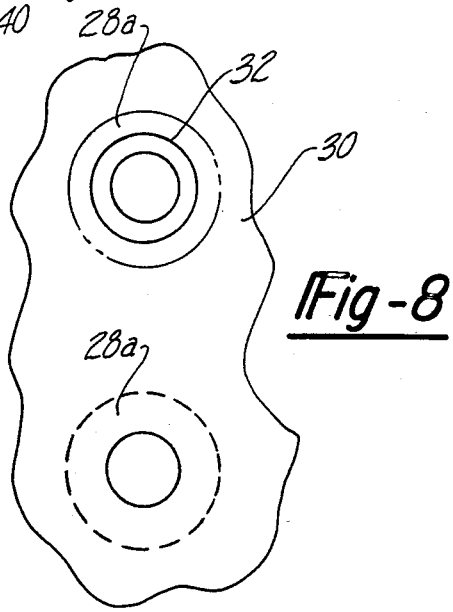

A modified sealing and clamping construction is shown in FIGS. 7 and 8 for use in applications requiring round cross section conductors rather than the flat, rectangular conductor bar stock used for conductor bars 20, 22, 24. In the FIGS. 7 and 8 construction, circular passages 28 are provided in a partition 30 for coaction with round cross section conductors 32. Each passage 28 is necked down at one end to form an annular lip portion 28*a* which tapers outwardly toward the other end of the passage to blend with the main body cylindrical portion 28*b* of the passage. The round cross section conductor 32 has a diameter that is slightly greater than the relaxed inner diameter of annular lip portion 28*a* and slightly less than the diameter of main body passage portion 28*b*. As conductor 32 is inserted into passage 28 from the left, as seen in FIG. 7, lip portion 28*a* is splayed elastically outwardly to pass the conductor element (not shown) positioned in a cavity defined to the right of partition 30. Lip portion 28*a* thus coacts with the outer periphery of conductor 32 to form a moisture seal at the partition. Lip portion 28*a* also acts to resist withdrawal of conductor 32 since any attempted withdrawal will tend to pivot lip portion 28*a* toward a more tightly closed clamping configuration. This arrangement prevents inadvertent withdrawal or displacement of the conductor bars while yet permitting withdrawal upon the application of a deliberate withdrawal force and, if desired, subsequent reinsertion for reassembly purposes.

Connector 12 is formed of a hard, rigid, plastic material such, for example, as a polyester, phenolic or the like. Connector 12 is generally hollow and includes an upper wall 12*a*, a lower wall 12*b*, sidewalls 12*c* and 12*d*, partitions 12*e* and 12*f*, and a locking tab 12*g* upstanding from top wall 12*a*. Partitions 12*e* and 12*f* coact with sidewalls 12*c* and 12*d* to define three parallel through passages 12*h*, 12*i* and 12*j*. A terminal 34 is positioned at the forward end of each passage 12*h*, 12*i* and 12*j*. A resilient tab 12*k* coacts with a detent in the top wall of each terminal 34 to maintain the terminal in its forward position within the connector upon insertion of a suitable tool into the forward end of the connector to resiliently raise the respective tab 12*k*. Three wires 36, 38, 40 are crimped at their forward ends to a respective terminal 34 and extend rearwardly therefrom through the appropriate passage 12*h*, 12*i*, 12*j*. Connector 12 is sized and configured to slide snugly into the connector cavity 10*c* of base 10 with conductor bar ends 20*a*, 22*a*, 24*a* each pressing firmly into a respective terminal 34 to establish a firm electrical connection between wires 36, 38, 40 and bars 20, 22, 24. As connector 12 slides into base cavity 10*c*, locking tab 12*g* cams upwardly over raised base portion 10*g* and then snaps downwardly to firmly embrace base portion 10*g*, firmly seat the connector in the base cavity, and preclude inadvertent withdrawal of the connector from the base. Also, as connector 12 slides into cavity 10*c*, resilient lip portions 10*h* (FIG. 2B), formed around the entire perimeter of the opening of cavity 10*c* in end face 10*d*, slidably and sealing wipe along upper and lower connector walls 12*a*, 12*b* and along connector sidewalls 12*c* and 12*d* to form a moisture seal between connector 12 and base 10 at the entrace to cavity 10*c*. The resilient polyurethane or the like material of lip portions 10*h* yield to allow insertion of the connector and conform snugly to the walls of the connector to optimize the mositure seal. If desired, wires 36, 38 and 40 may be potted into connector 12 to preclude the entry of moisture through the hollow interior of the connector.

Socket 14 is formed of a hard, rigid, plastic material such, for example, as a polyester, phenolic or the like. Socket 14 has a tubular configuration and includes a cylindrical sidewall 14*a*, defining a central bore 14*b*, and an external collar 14*c*. Socket 14 is received with a snap press fit in socket opening 10*a* of base 10. Specifically, as socket 14 is pressed downwardly into opening 10*a*, the chamfered leading edge portion 14*d* of the socket presses resiliently past an annular lip 10*i* in socket opening 10*a* and seats in an annular seat 10*j* defined immediately below lip 10*i*. At the same time, lip 10*i* seats in an annular notch seat 14*e* defined on socket 14 immediately above leading edge portion 14*d*, and collar 14*c* seats on the upper annular edge 10*k* of base rim portion 10*l* with a notch 14*f* in collar 14*c* embracing an upstanding post 10*m* on base 10 to insure proper indexing of socket 14 relative to base 10 during assembly and preclude subsequent inadvertent rotation of socket 14 relative to base 10. The resilient urethane or the like material of base 10 yields to allow insertion of socket 14 and conforms snugly to the inserted end of the socket to ensure an effective moisture seal for cavity 10*a*.

Bulb 16 is of the wedge base type and includes a glass envelope 16*a* housing a double filament, a glass wedge base 16*b* receiving and selectively exposing elements 16*c* of both filaments, and an external plastic collar 42 positioned at the necked down interface of the envelope 16*a* and wedge base 16*b*.

Bulb retainer 18 is formed of a hard, rigid, plastic material such, for example, as polyester, phenolic or the like. Bulb retainer 18 has a cylindrical, plug-like configuration and is received with a press fit in socket bore 14*b* to form a socket assembly. In assembled relation, the lower end 18*a* of the retainer projects slightly below the lower end of the socket. Retainer 18 includes an upstanding finger portion 18*b* and a rigid post portion 18*c*. Confronting lips 18*d* on finger portion 18*c* coact to define a generally rectangular opening 18*e* for receipt of bulb 16. As bulb 16 is pressed downwardly into retainer 18, wedge base 16*b* passes freely through opening 18*e* and through the opening defined between confronting rib portions 18*f* on post portion 18*c* and finger portion 18*b*. As the leading edge of collar 42 reaches opening 18*e*, collar 42 splays finger portion 18*b* outwardly to allow the collar to pass, whereafter finger portion 18*b* snaps back to firmly grasp the collar. In the inserted position of the bulb, confronting lips 18*d* embrace the bulb envelope 16*a* immediately above collar 42, confronting ribs 18*f* embrace the bulb base 16*b* immediately below collar 42, and wedge base 16*b* extends downwardly into a bulb cavity 18*g* defined between post portion 18*c* and finger portion 18*b* below ribs 18*f*.

The lower end of the inserted bulb coacts with three electrical contacts 44, 46, 48 (FIG. 5) encapsulated or potted in the lower end of retainer 18 to provide selective electrical communication between bulb 16 and conductor bars 20, 22, 24. Specifically, contact 44 includes a yoked upper end 44*a*, a bridge portion 44*b*, and a lower end 44*c*. Yoked upper end 44*a* embraces both sides of bulb base 16 and establishes electrical connection with exposed elements 16*c* of both bulb filaments. Lower end 44*c* establishes electrical connection with conductor bar 20. Contact 46 includes an upper end 46*a*, a bridge portion 46*b*, and a lower end 46*c*. Upper end 46*a* is positioned at one side of bulb base 16 to establish electrical connection with an exposed filament 16*c* of one of the bulb filaments and lower end 46*c* contacts conductor bar 22. Contact 46 thus establishes electrical connection between conductor bar 22 and one filament of bulb 16. Contact 48 includes an upper end 48*a*, a bridge portion 48*b*, and a lower end 48*c*. Upper end 48*a* is positioned at the other side of bulb base 16 to establish electrical connection with an exposed element 16*c* of the other bulb filament and lower end 48*c* contacts conductor bar 24. Contact 48 thus establishes electrical connection between conductor bar 24 and the other filament of bulb 16. Either filament of bulb 16 may thus be powered by powering the appropriate wire 38, 40. Contacts 44, 46, 48 are preferably formed of a beryllium copper material.

The invention lamp assembly is seen in FIG. 6 in a typical lamp environment such, for example, as an automotive tail lamp assembly. The invention lamp assembly is mounted with a twisting movement in the housing 50 of the tail lamp with cam members 14*g* on socket 14 coacting with suitable grooves in housing 50 to securely mount the lamp assembly in the housing. In assembled position, envelope portion 16*a* of bulb 16 is positioned within lamp parabola 52 to provide the required tail lamp illumination.

In operation, the heat generated by bulb 16 has the effect of heating the lamp assembly and, specifically, significantly elevating the temperature of the air in cavity 10*a*. When the lamp is subsequently extinguished, the air in cavity 10*a* cools and contracts to form a vacuum condition in the cavity. The vacuum condition in cavity 10*a* operates to attempt to suck moisture laden air into the cavity. If moisture is thus introduced into the cavity, galvanic action occurs at the interface of contacts 44, 46, 48 and conductors 20, 22, 24 and the resulting corrosion eventually renders the lamp inoperative. Introduction of moisture into cavity 10*a* is effectively precluded, however, in the invention lamp assembly by the mechanical interference seal formed at the interface of socket 14 in base 10 and at the point of passage of conductors 20, 22, 24 through partition 10*e*. Moisture sealing of the lamp assembly is further facilitated by the mechanical interference fit between the base and the connector.

The invention lamp assembly thus achieves effective moisture sealing by purely mechanical means and provides component parts which are readily assembled and disassembled. Since the invention lamp assembly achieves effective moisture sealing without resort to potting or grease packing, the lamp assembly may be selectively assembled in the specific manner or sequence that is most compatible with the assembly process of the apparatus or machine of which the lamp assembly will become a part. In the case of a tail lamp assembly for an automobile where the location of the lamp housing and of the vehicular wiring harness are essentially givens dictated by various automotive design and styling parameters, the various components of the invention lamp assembly may be selectively assembled, either by the parts supplier or by the orginal equipment manufacturer, in whatever sequence is most compatible with the total automotive assembly process and may be selectively connected to the lamp housing and to the wiring harness in whatever manner is most consistent with optimal assembly efficiency. The invention lamp assembly also allows later disassembly for repair without destroying the moisture seal, since the moisture seal is reestablished whenever the various components are reassembled. As compared to prior art encapsulated or grease packed lamp assemblies, the invention lamp assembly provides greater flexibility in the original assembly process, allows later repair without destruction of the moisture seal, provides a more effective moisture seal, and allows economy of manufacture by eliminating the labor and materials required to achieve the encapsulation or packing.

While preferred embodiments of the invention have been illustrated and described in detail, it will be apparent that various changes may be made in the disclosed embodiment without departing from the scope or spirit of the invention.

I claim:

1. A lamp assembly comprising:

(A) a base having a peripheral wall defining a socket cavity having an opening in one face of said base;

(B) a socket assembly defining a bulb cavity and including a plurality of contact elements having their one ends positioned in said bulb cavity to electrically connect with a bulb inserted into said bulb cavity and having their other ends positioned at one end of said socket assembly;

(C) a plurality of elongated conductors passing sealingly through said wall of said base to position their one ends in said socket cavity;

(D) coacting means on said socket assembly adjacent said one end thereof and on said wall resiliently yieldable in response to insertion of said one end of said socket assembly into said socket cavity through said opening to sealingly mount said one socket assembly end in said socket cavity by effecting sealing engagement between said coacting means entirely around said socket cavity and also to connect said other ends of said contact elements in respective electrical contact with said one ends of said conductors.

2. A lamp assembly according to claim 1 wherein said lamp assembly further includes:

(E) a connector having a plurality of terminals separable from said conductors and adapted to respectively electrically connect with the other ends of said conductors;

(F) said base further defines another cavity opening in another face of said base and separated by said wall from said socket cavity;

(G) said terminals are received in one end of said connector; and (H) the other end of said connector is sized and configured to be inserted into the opening of said other base cavity to provide respective electrical connection between said connector terminals and the other ends of said conductors, said connector and base having sealing portions resiliently engageable in sealing relationship in response to insertion of said connector into said opening of said other base cavity for closing the latter opening entirely around said connector.

3. A lamp assembly according to claim 1 wherein:

(I) a plurality of passages extend longitudinally through said wall;

(J) said elongated conductors extend respectively through said passages;

(K) each such passage defines a relatively small lateral dimension opening adjacent said socket cavity and tapers into the socket cavity;

(L) each said elongated conductor has a substantially uniform thickness which is slighly greater than the lateral dimension of said passage opening and slighly less than the lateral dimension of said passage remote from said socket cavity, whereby each said elongated conductor, upon insertion through a respective passage into said socket cavity, forms a tight seal for said socket cavity at said wall and resists withdrawal through said passage.

4. A lamp assembly comprising:

(A) a socket assembly having a socket adapted to releasably receive a bulb, said socket assembly also having a plurality of terminals at one end thereof adapted to electrically connect with a bulb received in said socket;

(B) a connector;

(C) a plurality of terminals positioned in said connector;

(D) a base defining a socket assembly cavity having an opening in one face of said base, a connector cavity having an opening in another face of said base remote from said one face, and a partition separating said cavities;

(E) a plurality of elongated conductors extending in parallel fashion through said partition with their one ends disposed in said socket assembly cavity, their other ends disposed in said connector cavity, and sealingly passing intermediate their ends through said partition;

(F) coacting means on said socket assembly adjacent said one end thereof and on said base adjacent said socket assembly cavity operative in response to insertion of said one end of said socket assembly into said socket assembly cavity through said socket assembly cavity opening to sealingly and disassemblably position said one socket assembly end in said socket assembly cavity with said socket assembly terminals in respective electrical contact with said one ends of said conductors; and (G) coacting means on said connector and on said base adjacent said connector cavity operative in response to insertion of said connector into said connector cavity through said connector cavity opening to sealingly and disassemblably position said connector in said connector cavity to close the latter opening entirely around said connector and also to position said connector terminals in respective electrical contact with said other ends of said conductors.

5. A lamp assembly according to claim 4 wherein said connector, base, and socket assembly, in assembled relation, are formed of alternating relatively hard and relatively soft dielectric materials so that the sealing interface between said connector and said base and between said socket assembly and said base is, in each instance, between a relatively hard and a soft material.

6. A lamp assembly according to claim 5 wherein said base is formed of a relatively resilient material and said connector and said socket assembly are formed of relatively rigid material.

7. A lamp assembly according to claim 6 wherein said base is formed of a polyurethane material and said connector and said socket assembly are formed of a polyester material.

8. A lamp assembly including a pair of separate interfittable elements comprising a socket assembly and a base, said socket assembly and base having resiliently yieldable interfitting portions attachable together to define a socket cavity and a sealed perpheral wall around said socket cavity, said peripheral wall and base closing one end of said socket cavity, a bulb holder in said socket assembly having a bulb cavity for reception of a bulb insertable therein, electrical conductor means assembled with said bulb holder, said conductor means having electrical contacts within said bulb cavity for electrically connecting with a bulb inserted in said bulb cavity and also having electrical terminals within said socket cavity, a plurality of conductors having terminals at their one ends in electrical connection with said electrical terminals of said conductor means, passage means extending through said peripheral wall, said conductors extending through said passage means into said socket cavity for effecting said electrical connection between said terminals of said conductors and conductor means.

9. A lamp assembly according to claim 8, said socket assembly comprising a bulb holder of hard resilient dielectric material having inner and outer ends, said bulb holder having a base portion at said inner end within said socket cavity and also having opposing walls extending toward said outer end from said base portion and defining said bulb cavity opening outwardly at said outer end, at least one of said opposing walls comprising a cantilevered member joined only at said inner end to said base portion and free at said outer end for resiliently swinging by wedge action upon passage of an enlarged portion of a bulb into said bulb cavity and for thereafter snapping back to releasably retain said enlarged bulb portion within said bulb cavity.

10. A lamp assembly according to claim 8, said passage means comprising a plurality of passage for said conductors respectively, each of said passages being oversize with respect to the associated conductor passing freely therethrough, said peripheral wall defining a separate tapered resiliently yieldable lip restricting the end of each of said passages at said socket cavity, each lip extending around and in resilient sealing engagement with the associated conductor passing through the associated passage, each lip also extending from said wall into said socket cavity and tapering in the direction of extension into said socket cavity and toward the associated conductor to facilitate insertion of the associated conductor through the associated passage into said socket cavity and to resist withdrawal of said associated conductor from said socket cavity.

11. A lamp assembly according to claim 8, said socket assembly comprising a socket housing and a separate bulb holder supported within said socket housing, said bulb holder having inner and outer ends and comprising a hard resilient dielectric material, said bulb cavity opening outwardly at said outer end, said conductor means being assembled within said bulb holder and extending through said inner end and terminating at its said terminals within said socket cavity for effecting said electrical connection with said terminals of said conductors.

12. A lamp assembly according to claim 8, and also comprising a connector assembly separate from said pair of elements and having electrical contacts engageable with the other ends of said conductors, said connector assembly and one of the other of said pair of elements having interfitting portions for attachment together in sealing relationship to provide a connector cavity having one end of said connector assembly therein, said sealing relationship comprising a seal between said one element and connector assembly closing said connector cavity entirely around said connector assembly, said peripheral wall comprising a partition wall between said connector and socket cavities, said passage means comprises a plurality of passages extending through said partition wall and each connecting said connector cavity and said socket cavity, said conductors extending respectively through said passages from said connector cavity into said socket cavity, and means associated with each passage providing an interference fit and sealing engagement with the conductor extending therethrough for closing the associated passage.

13. A lamp assembly according to claim 12, said base has said socket cavity in one face thereof partially filled by said socket assembly interfitting therein in said sealing relationship, said one of said pair of elements having said connector cavity partially filled by said connector assembly interfitting therein said sealing relationship, said socket assembly comprising a socket housing and a separate bulb holder, said bulb holder comprising a hard resilient dielectric material having inner and outer ends and being confined within said socket housing, said bulb holder having a base portion at said inner end adjacent to said socket cavity and also having opposing walls extending toward said outer end from said base portion and defining said bulb cavity opening outwardly at said outer end, at least one of said opposing walls comprising a cantilevered member joined only at said inner end to said base portion and free at said outer end for resiliently swinging by wedge action upon passage of an enlarged portion of a bulb into said bulb cavity and for thereafter snapping back to releasably retain said enlarged bulb portion within said bulb cavity, said electrical conductor means having portions extending through said base portion from said electrical contacts within said bulb cavity to said terminals of said conductor means within said socket cavity.

14. A lamp assembly according to claim 13, said interfitting portions of said socket assembly and base comprising coacting means operative in response to insertion of said socket assembly into said socket cavity to electrically connect said terminals of said conductor means with said terminals at said one ends of said conductors within said socket cavity, and said interfitting portions of said connector assembly and said one of said pair of elements comprising coactive means operative in response to insertion of said connector assembly into said connector cavity to electrically connect said electrical contacts of said connector assembly with said other ends of said conductors.

15. A lamp assembly according to claim 12, said base comprises relatively resilient dielectric material, said socket and connector assemblies comprise relatively rigid dielectric material, said base has said socket cavity in one face thereof partially filled by said socket assembly interfitting therein in said sealing relationship, said base also having a connector cavity in another face thereof partially filled by said connector assembly interfitting therein in said sealing relationship, said partition wall comprising a wall portion of said base partitioning said socket and connector cavities.

16. A lamp assembly according to claim 15, said interfitting portions of said socket assembly and base comprising coacting means operative in response to insertion of said socket assembly into said socket cavity to electrically connect said terminals of said conductor means with said terminals at said one ends of said conductors within said socket cavity, and said interfitting portions of said connector assembly and said base also comprising coactive means operative in response to insertion of said connector assembly into said connector cavity to electrically connect said electrical contacts of said connector assembly with said other ends of said conductors.

17. A lamp assembly according to claim 15, said base comprising said one of said pair of elements, said interfitting portions of said one element and connector assembly comprising a bead of said relatively resilient material of said base, said bead comprising a unitary portion of said base extending around the interior surface of said connector cavity and engageable with the exterior surface of said connector assembly to be stretched thereby into said sealing relationship with said exterior surface when said connector assembly is inserted into said connector cavity.

18. A lamp assembly according to claim 15, said passage means comprising a separate oversize passage for each conductor respectively passing freely therethrough, said peripheral wall defining a separate tapered resiliently yieldable lip restricting the end of each of said passage at said socket cavity, each lip extending around and in resilient sealing engagement with the associated conductor passing through the associated passage, each lip also extending from said wall into said socket cavity and tapering in the direction of extension into said socket cavity and toward the associated conductor to facilitate insertion of the associated conductor through the associated passage into said socket cavity and to resist withdrawal of said associated conductor from said socket cavity, each conductor comprising an elongated rod sufficiently rigid to enable said insertion in said direction through the restricted end of the associated passage.

19. A lamp assembly comprising a socket assembly and a base having portions interfitting to define a socket cavity therebetween; said socket assembly comprising a housing, electrical conductor means, and a bulb holder; said bulb holder having inner and outer ends, an outwardly opening bulb cavity in said outer end for receiving a bulb insertable therein, and a base portion fitting within said socket cavity at said inner end; said electrical conductor means having electrical contacts arranged in said bulb cavity for electrically connecting with a bulb inserted into said bulb cavity and also having electrical contact terminals extending through said base portion into said socket cavity; said bulb holder comprising a hard resilient dielectric material, said base portion of said bulb holder having spaced walls extending toward said outer end to define said bulb cavity, at least one of said spaced walls comprising a cantilevered finger member joined only at said inner end to said base portion and free at said outer end for swinging resiliently by wedge action for passage of a wedge base of a bulb into said bulb cavity and for thereafter snapping back to releasably retain said wedge base within said bulb cavity, said bulb cavity being of generally rectangular cross section for receiving a wedge base of generally rectangular cross section, the spacing between said spaced walls comprising the shorter dimension of said generally rectangular cross section of said bulb cavity, the longer dimension of the latter cross section being normal to said shorter dimension to provide a comparatively large dimension for the surface contact between said spaced walls and wedge base compared to said shorter dimension, said spaced walls having confronting channels therein adjacent to and spaced from said outer end, said channels opening toward each other and extending lengthwise of said longer dimension.

20. A lamp assembly according to claim 19, said housing having a cylindrical interior opening at axially opposite inner and outer ends, said base portion of said bulb holder being cylindrical and fitting coaxially within said cylindrical interior adjacent to the latters axially inner end, said outwardly opening bulb cavity opening axially at said axially outer end, and a portion of said cylindrical interior confronting said resiliently yieldable cantilevered finger member being spaced radially outwardly from said finger member to enable resilient yielding thereof by said wedge action.

21. A lamp assembly including three separate interfittable elements comprising a socket assembly, a base, and a connector assembly; said socket assembly and base having resiliently yieldable interfitting portions attachable together to define a socket cavity and a sealed peripheral wall around said socket cavity; said peripheral wall and base closing one end of said socket cavity; a bulb holder having a bulb cavity for reception of a bulb insertable therein; electrical conductor means assembled with said bulb holder; said conductor means having electrical contacts within said bulb cavity for electrically connecting with a bulb inserted in said bulb cavity and also having electrical terminals within said socket cavity; a plurality of conductors having terminals at their one ends in electrical connection with said electrical terminals of said conductor means; said connector assembly and one of the other two of said elements having interfitting portions for attachment together in sealing relationship to provide a connector cavity having one end of said connector assembly inserted therein, said peripheral wall comprising a partition wall between said connector and socket cavities, passage means extending through said partition wall to connect said connector cavity and said socket cavity, said conductors extending from said connector cavity through said passage means in sealing relationship to close the latter and to effect said electrical connection between said terminals of said conductors and conductor means within said socket cavity, said connector assembly having electrical contacts connectible with the other ends of said conductors, the sealing relationship between said one element and connector assembly comprising a seal closing said connector cavity entirely around said connector assembly.

22. A lamp assembly according to claim 21, a portion of said socket assembly being insertable into said socket cavity, said interfitting portions of said socket assembly and base comprising coacting means operative in response to insertion of said portion of said socket assembly into said socket cavity to electrically connect said terminals of said conductor means with said terminals at said one ends of said conductors within said socket cavity, and said interfitting portions of said connector assembly and said one of said pair of elements comprising coactive means operative in response to insertion of said one end of said connector assembly into said connector cavity to electrically connect said electrical contacts of said connector assembly with said other ends of said conductors.

23. A lamp assembly according to claim 22, said base comprising said one of said elements and also comprising a relatively flexible resilient material, said interfitting portions of said one element and connector assembly comprising a bead of said relatively flexible resilient material of said base, said bead comprising a unitary portion of said base extending around the interior surface of said connector cavity and engageable with the exterior surface of said connector assembly to be stretched thereby into said sealing relationship with said exterior surface when said one end of said connector assembly is inserted into said connector cavity.

* * * * *